United States Patent [19]

Nishikawa

[11] 4,392,737

[45] Jul. 12, 1983

[54] ELECTROPHOTOGRAPHIC COPYING APPARATUS

[75] Inventor: Masaji Nishikawa, Hachioji, Japan

[73] Assignee: Olympus Optical Co. Ltd., Tokyo, Japan

[21] Appl. No.: 324,098

[22] Filed: Nov. 23, 1981

[30] Foreign Application Priority Data

Dec. 2, 1980 [JP] Japan ..... 55-169826

[51] Int. Cl.[3] ..... G03G 15/00

[52] U.S. Cl. ..... 355/3 R; 355/14 R; 430/54

[58] Field of Search ..... 355/3 R, 11, 3 TR, 7, 355/16, 14 R; 430/31, 54, 48, 126

[56] References Cited

U.S. PATENT DOCUMENTS 3,836,363 9/1974 Plutchak ..... 355/4
4,171,157 10/1979 Suzuki ..... 355/3 TR
4,253,760 3/1981 Tsuda et al. ..... 355/14 CU
4,297,423 10/1981 Nishikawa ..... 430/54

FOREIGN PATENT DOCUMENTS 54-60930 5/1979 Japan .

*Primary Examiner*—R. L. Moses
*Attorney, Agent, or Firm*—Weinstein & Sutton

[57] ABSTRACT

An electrophotographic copying apparatus comprises a photosensitive member which includes a conductive layer carrying a sequential lamination of a first photoconductive layer which is sensitive to visible light and a second photoconductive layer which is sensitive to ultraviolet rays and serves as an insulator to the visible light and a neutralizing unit for an irradiation of visible light and ultraviolet ray in order to neutralize charge on an area beyond image scope of the photosensitive member.

7 Claims, 31 Drawing Figures

FIG. 1 (II)

FIG. 1 (III)

FIG. 2 (III)

FIG. 2 (IV)

FIG. 6(III)
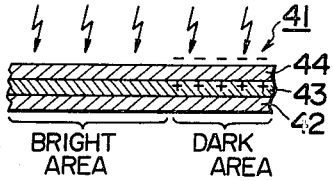
FIG. 7(III)
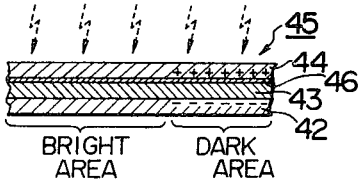

FIG. 9(III)
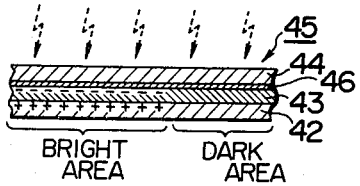

FIG. 10(I)
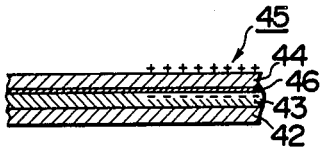
FIG. 10(II)
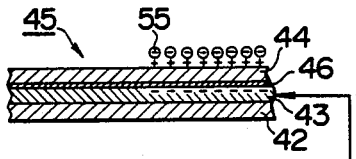
FIG. 10(III)
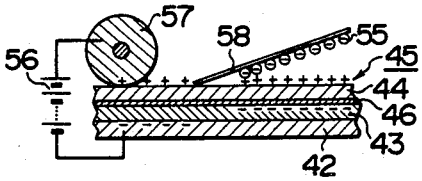
FIG. 10(IV)
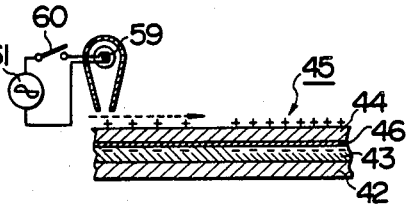
FIG. 10(V)
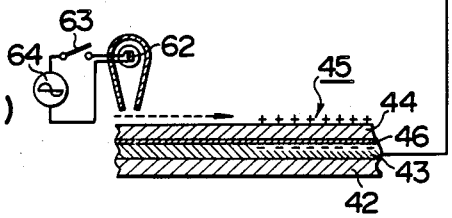
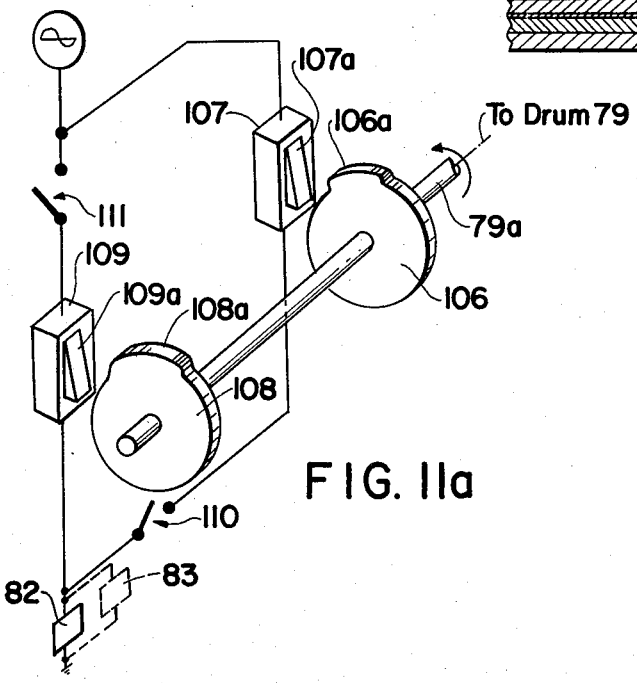
FIG. 11a
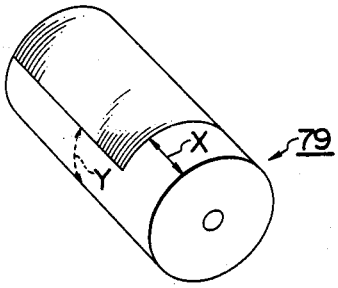
FIG. 12

ELECTROPHOTOGRAPHIC COPYING APPARATUS

BACKGROUND OF THE INVENTION

The invention relates to an electrophotographic copying apparatus, and more particularly, to an electrophotographic copying machine comprising a photosensitive member for performing electrophotography which member includes a conductive layer carrying a sequential lamination of a first photoconductive layer which is sensitive to visible light and a second photoconductive layer which is sensitive to ultraviolet rays and which serves as an insulator to the visible light and on which member an electrostatic latent image is formed, whereby a plurality of copies are produced by repeatedly using the latent image once formed.

In general, an electrophotographic copying apparatus, as is well recognized, is constructed to produce a copy from different kinds of originals in size and therefore its photosensitive member is formed so as to accommodate the greatest size of originals.

However, when a copy of an original smaller than the greatest size is produced, an area on the photosensitive member where an electrostatic latent image corresponding to an original image to be copied is formed does not cover the entire surface of the photosensitive member. In other words, there exists a part of the entire photosensitive member surace which it does not face a copy sheet to be copied because of a difference in size (hereinafter referred to as an area beyond image scope). When a developing operation is performed on the area beyond image scope on the photosensitive member under its charged condition, a variety of difficulties arises from depositing a developing toner on the area beyond image scope. For example, some of the difficulties which are encountered include a deterioration of a transfer capability of the latent image due to depositing the developing toner on a transfer roller, contamination of copy sheets due to retransferring the developing toner deposited on the transfer roller to the back of the copy sheets, waste of the developing toner, or the like.

The causes that the area beyond image scope on the photosensitive member is charged are as follows.

(a) Charge generated during a charging process for forming an electrostatic latent image is not eliminated.

(b) Charge is directly injected from a transfer roller, to which is normally applied a bias voltage, due to no interposition of a copy sheet during a step for transferring, and the like.

Since these unnecessary charges on a photosensitive member for use in an electrophotographic copying apparatus which utilizes the conventional well-known Carlson's process can be removed only by an irradiation of visible light, there has been disclosed an apparatus that is provided with a lamp for eliminating the charge on the area beyond image scope by an irradiation of visible light prior to a developing operation.

However, even with such charge eliminating means, charge on the area beyond image scope could not be eliminated in an electrophotographic copying process employing a photosensitive member which includes a conductive layer carrying a sequential lamination of a first photoconductive layer which is sensitive to visible light and a second photoconductive layer which is sensitive to ultraviolet rays. This is because once the area beyond image scope has been charged after formation of an electrostatic latent image, charge trapped on the surface of the photosensitive member and on the conductive layer by charge having access to the outside is retrapped to remain on opposite sides of the second photoconductive layer which is not excited even by the irradiation of the visible light alone.

FIG. 1 illustrates a sequence of electrophotographic copying steps for producing a plurality of copy images by repeatedly subjecting an electrostatic latent image formed by the conventional Carlson's process to a developing and a transfer step. As shown, a photosensitive member 1 includes a conductive layer 2 on which a photoconductive layer 3 is laminated. FIGS. 1(I) to (V) respectively show a step for uniform charging of the photosensitive member 1 to the positive polarity by a corona charger 4, a step for an imagewise irradiation 12, a step for developing with a magnet brush 6 having a negatively charged toner, a step for transfer of a toner image on a sheet 7 to be copied with a transfer roller 9 connected to a transfer bias source 8 and a step for a neutralization of charge. Particularly, in the step of FIG. 1(IV), a charge injection onto the area beyond image scope of the photosensitive member 1 will happen as shown. And in the step of FIG. 1(V), in order to eliminate the charge injected onto the area beyond image scope an irradiation of visible light is carried out with a lamp 11 for neutralization which is connected to a power supply 10 only on the area beyond image scope indicated by broken lines with an arrow. Thereafter, by repeatedly performing the steps shown in FIGS. 1(III) to (V) successively, a plurality of copies can be produced with an electrostatic latent image which is once formed on the photosensitive member 1.

Apart from the electrophotographic copying process described above, there has been known such an electrophotographic copying process using a photosensitive member and which includes a conductive layer carrying a sequential lamination of a photoconductive layer and an insulator layer, an electrostatic latent image is formed by trapping charge on opposite sides of the insulator layer during a combination of steps for a corona charging, imagewise exposure, uniform exposure of light rays and the like, and an improvement on such electrophotographic copying process in which a photosensitive layer which is sensitive to ultraviolet rays is utilized on the surface of the photosensitive member instead of the insulator layer. Additionally, the inventor has developed a photosensitive member which includes a conductive layer carrying a sequential lamination of a photoconductive layer which is sensitive to visible light, a filter layer for absorbing ultraviolet rays and a photoconductive layer which is sensitive to ultraviolet rays, and an electrophotographic copying process which utilizes the photosensitive member. In these photosensitive members, the photoconductive layer which is sensitive to ultraviolent rays as well as the conductive layer on the surface thereof serves as an insulator during an irradiation of visible light, not allowing charge to migrate. Therefore, in an electrophotographic copying process employing a photosensitive member which includes such insulator on the surface thereof, even if an attempt is made to remove the charge which is injected into the area beyond image scope during a step for producing a plurality of copies, it will be impossible to eliminate the charge. This will be explained, by way of example, in FIGS. 2(I) through (IV) illustrating an electrophotographic copying process for producing a plurality of copies. As shown in FIG. 2(I), a photosensitive member 21 which includes a conductive layer 22 carrying a sequential lamination of a photoconductive layer 23 which is sensitive to visible light and a light transmitting insulator layer 24 is employed and an electrostatic latent image is formed by trapping charges of opposite polarities on opposite sides of insulator 24. The latent image, which is to be subjected only to a developing and a transfer step to produce a plurality of copies, is developed by a magnet brush 26 which has a negatively charged toner 25 in a developing step shown in FIG. 2(II). In a transfer step shown in FIG. 2(III), the toner image is transferred onto a copy sheet 29 under the action of a transfer roller 28 which is connected to a transfer bias source 27 and to which is applied a bias voltage. Simultaneously with the transfer process a charge is injected from transfer roller 28 onto the area beyond image scope of photosensitive member 21. FIG. 2(IV) illustrates a step in which the useless charge on the area beyond image scope is neutralized by an irradiation of visible light with a neutralization lamp 31 which is connected to a power supply 30 in accordance with the conventional known art. Specifically, the area beyond image scope to be neutralized is shown by broken lines with an arrow. With the area irradiated by visible light, the charge thereon is trapped at the interface between opposite sides of insulator layer 24, failing to be removed. Even with such electrophotographic copying process, a plurality of copies may be produced with an electrostatic latent image which is once formed on photosensitive member 21 by repeatedly performing only steps shown in FIGS. 2(II) through (IV) successively.

Thus, when the photosensitive member is used which includes an insulator layer on the surface thereof, a charge on the area beyond image scope may not be neutralized only by visible light. Consequently, toner is deposited on the area beyond image scope, which has not been neutralized, resulting in disadvantages such as a waste of toner, contamination of a transfer roller and the back of a copy sheet, or the like. It is to be noted that these disadvantages may be caused similarly even when a photoconductive layer which is sensitive to ultraviolet rays but insensitive to visible light is used as a surfacial insulator layer.

SUMMARY OF THE INVENTION

It is an object of the invention to eliminate the above described drawbacks by providing an electrophotographic copying apparatus comprising neutralization means for effectively neutralizing a useless charge on an area beyond image scope of a photosensitive member which includes a conductive layer carrying a sequential lamination of a first photoconductive layer which is sensitive to visible light and a second photoconductive layer which is sensitive to ultraviolet rays and which serves as an insulator to the visible light.

In accordance with the invention, in the electrophotographic copying apparatus employing the photosensitive member which includes a conductive layer carrying a sequential lamination of a first photoconductive layer which is sensitive to visible light and a second photoconductive layer which is sensitive to ultraviolet rays, neutralization means for irradiating the visible light and ultraviolet rays on the area beyond image scope of the photosensitive member is provided during steps for producing a plurality of copies, exhibiting its outstanding effects such as a prevention against waste of developing toner, a reduction in load on a cleaning unit of the photosensitive member, and the like.

BRIEF DESCRIPTION OF THE DRAWINGS

FIGS. 10(I) through (V) schematically illustrate a sequence of copying steps for explaining operations of the electrophotographic copying apparatus of the present invention;

FIG. 11*a* shows an electrical circuit for energizing the neutralizing circuits during the copy cycle; and FIG. 12 is a perspective view of a photosensitive drum for use in the copying apparatus shown in FIG. 11.

DESCRIPTION OF PREFERRED EMBODIMENT

Figure 1:
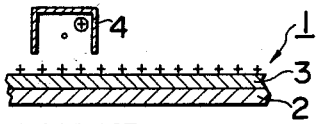
FIGS. 1(I) through (V) schematically illustrate a sequence of copying steps for an electrophotographic copying process in accordance with the conventional Carlson's process.
Figure 1:
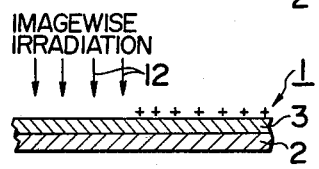
Figure 1:
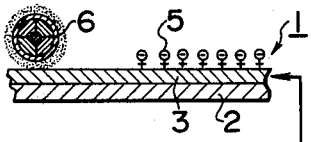
Figure 1:
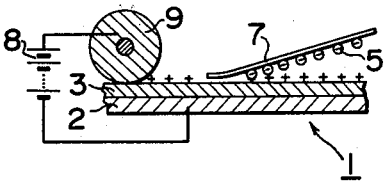
Figure 1:
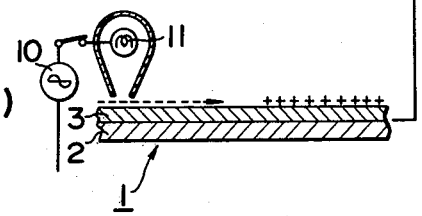
Figure 2:
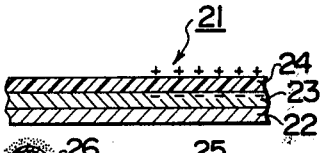
FIGS. 2(I) through (IV) schematically illustrate a sequence of copying steps for a conventional electrophotographic copying process other than the Carlson's process.
Figure 2:
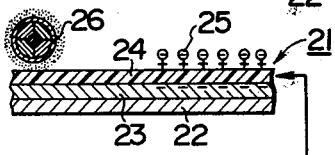
Figure 2:
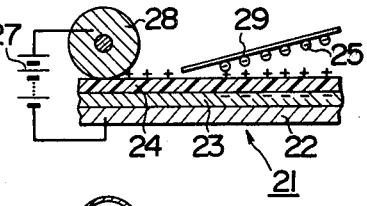
Figure 2:
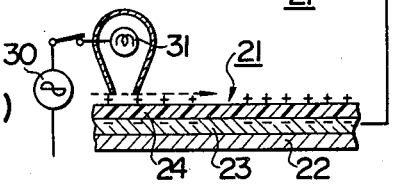
Figure 3:
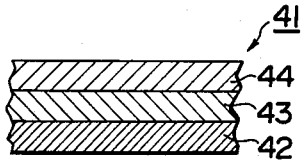
FIG. 3 is a schematic cross section of one form of photosensitive member for use in the present invention.

Referring to FIG. 3, there is shown one form of photosensitive member which may be used in the electrophotographic copying apparatus of the present invention, in schematic cross section. A photosensitive member 41 shown comprises a conductive layer 42 carrying a successive lamination of a first photoconductive layer 43 which is sensitive to visible light (radiation in a first wavelength region), and a second photoconductive layer 44 which transmits the visible light and which is sensitive to ultraviolet rays in a wavelength region different from the first wavelength region (radiation in a second wavelength region). The conductive layer 42 is also effective as a support for the entire photosensitive member 41 and may be formed by a metal such as aluminium or a polyester film having a metalized surface. The first conductive layer 43 which is sensitive to the radiation in the first wavelength region may comprise Se, Se alloys, amorphous silicon, CdS, ZnO and PVK (polyvinylcarbazole) containing a sensitizer such as TNF (2,4,7-trinitro-9-fluorenone) or the like, which are themselves known in the art. The second photoconductive layer 44 which is sensitive to radiation in the second wavelength region may comprise PVK, amylhydrazones, oxazoles, pyrazolidones, 4–5 diphenyl imidazoles, 1,3,4 triazoles, oxydiazoles, perillenes, for example. However, since the material which forms the first photoconductive layer 43 is generally sensitive to ultraviolet rays in addition to visible light, it is desirable that the material to form the second photoconductive layer 44 be selected in connection with the material to form the first photoconductive layer 43 so that radiation in the second wavelength region cannot reach the first photoconductive layer 43, or stated differently, so that the second photoconductive layer 44 has a good absorption of radiation in the second wavelength region.

Figure 4:
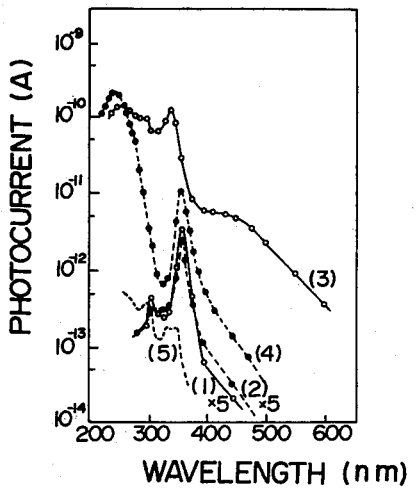
FIG. 4 graphically shows the spectral photocurrent response and absorption spectral response of PVK (polyvinylcarbazole)

FIG. 4 graphically shows the spectral photocurrent response and the absorption spectrum of PVK which may be used as a material to form the second photoconductive layer 44. The sample comprises 15 μm thick PVK layer which is sandwiched between Au and Nesa glass and the measurement is made in a high vacuum. Curves (1) and (3) indicate the spectral photocurrent response when the Nesa glass is connected to the ground and a voltage of plus 2 and 50 volts, respectively, is applied to the Au electrode. Curves (2) to (4) indicate the spectral photocurrent response when the Au electrode is connected to the ground while a voltage of minus 2 and 50 volts, respectively, is applied to the Nesa glass. Curve (5) represents the absorption spectrum. As will be apparent from FIG. 4, PVK exhibits a reduced absorption in a region of wavelengths from 310 to 350 nm and exhibits little absorption of light having a wavelength greater than 350 nm. When such PVK is used to form the second photoconductive layer 44, a material may be chosen to form the first conductive layer 43 which is sensitive to radiation of wavelengths greater than 350 nm and is not sensitive to radiation of wavelengths below such value.

Figure 5:
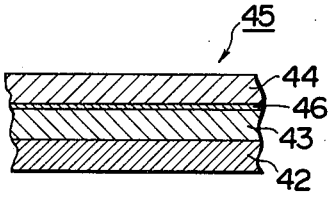
FIG. 5 is an enlarged cross section of another form of photosensitive member for use in the present invention.

FIG. 5 shows, in schematic cross section, another form of photosensitive member which may be used in carrying out the electrophotographic process of the invention. Photosensitive member 45 comprises an ultraviolet absorbing filter layer 46 which is interposed between a first photoconductive layer 43 and a second photoconductive layer 44. In other respects, the photosensitive member is similar to that shown in FIG. 3. The ultraviolet absorbing filter layer 46 comprises a light transmitting resin such as polyvinyl chloride, polymethylmethacrylate, polyethylene or the like in which an ultraviolet absorber is blended. An ultraviolet absorber may comprise benzophenones or triazoles including 2,2'-dihydroxy-4,4'-dimethoxybenzophenone
2,2'-dihydroxy-4-methoxybenzophenone
2-(2'-hydroxy-5'-methylphenyl)benzotriazole
2-(2'-hydroxy-5'-methylphenyl)-5,6-dichlorobenzotriazole A preferred thickness of the ultraviolet absorbing filter layer 46 is less than several microns. An increased thickness results in the presence of residual charge, which in turn causes a fogging in the background. A preferred proportion of the ultraviolet absorber is from 5 to 100 parts by weight with respect to 100 parts by weight of the resin when the film thickness is 1 micron.

When the ultraviolet absorbing filter layer 46 is thus formed between the first and the second photoconductive layer 43, 44, ultraviolet rays are absorbed by the filter layer 46 and cannot reach the first conductive layer 43 if the latter is sensitive to ultraviolet radiation, thus effectively preventing the first conductive layer 43 from responding to radiation in the second wavelength region. Consequently, the choice of materials to form the first and the second photoconductive layer 43, 44 is greatly facilitated.

It should be understood that instead of forming an ultraviolet absorbing filter layer 46 independently, an ultraviolet absorber of the kind described above may be dispersed into the materials which formed the first and the second photoconductive layer 43, 44 in the vicinity of a boundary therebetween to provide effective filtering action. Alternatively, an ultraviolet absorber of a relatively low concentration may be uniformly dispersed throughout the material which forms the second photoconductive layer 44.

A number of procedures for forming an electrostatic latent image on the photosensitive member shown in FIGS. 3 and 5 will now be described.

Figure 6I:
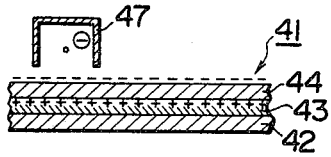
FIGS. 6(I) through (III), FIGS. 7(I) through (III), FIGS. 8(I) and (II), and FIGS. 9(I) through (III) schematically illustrate steps for forming an electrostatic latent image on the photosensitive member for use in the present invention, respectively.
Figure 6:
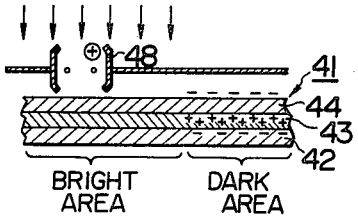

FIGS. 6(I) through (III) schematically illustrate one example of a sequence of steps for forming an electrostatic latent image on photosensitive member 41 shown in FIG. 3. As indicated in FIG. 6(I), initially the photosensitive member 41 is uniformly charged to a negative polarity, for example, by a corona charger 47 in darkness. The operation is such, that when the dark resistance of the first photoconductive layer 43 is low, charges having opposite polarities are trapped on opposite sides of the second photoconductive layer 44 as shown in the figure. When the dark resistance of the first photoconductive layer 43 is sufficiently high, a uniform charging during a uniform exposure of visible light is performed so that charge may be trapped on opposite sides of the second photoconductive layer 44. Subsequently, as indicated in FIG. 6(II), an image of an original formed by visible light in the first wavelength region is projected onto the photosensitive member 41 while simultaneously a charging with the opposite polarity or an a.c. charging is performed by a corona charger 48 so that a surface potential of the photosensitive member 41 is neutralized to reach substantially zero volts. The neutralization is followed by a uniform exposure by visible light, as indicated in FIG. 6(III). As a result of such uniform exposure, in a bright area of the image, the negative charge is trapped on the surface of the second photoconductive layer 44 and the positive charge is trapped at the interface between the first and the second photoconductive layers 43, 44, thus forming the electrostatic latent image. It is to be noted that the described step for forming the electrostatic latent image is also applicable to the photosensitive member 45 in the similar manner.

Figure 7I:
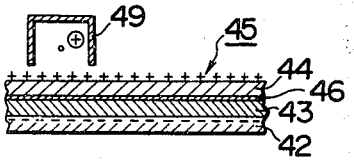
Figure 7:
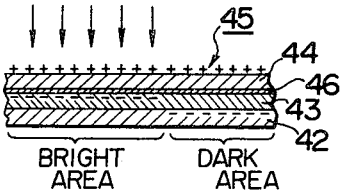

FIGS. 7(I) through (III) schematically illustrate another example of a sequence of steps for forming an electrostatic image on the photosensitive member 45 shown in FIG. 5. As indicated in FIG. 7(I), the photosensitive member 45 is uniformly charged to the positive polarity, for example, by a corona charger 49 in darkness. Subsequently, an image of an original formed by visible light in the first wavelength region is projected onto the photosensitive member 45, as indicated in FIG. 7(II), resulting in a change only in a bright area of the image in location where a charge is trapped. The step of FIG. 7(II) is followed by a uniform exposure by ultraviolet rays as indicated in FIG. 7(III). As a result of such uniform exposure by ultraviolet rays, the charge is eliminated from the bright area of the image, while in a dark area thereof, charges of opposite polarities are trapped on opposite sides of the first conductive layer 43, thus forming the electrostatic latent image.

Figure 8I:
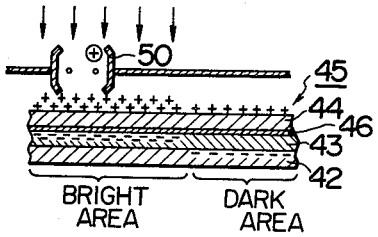
Figure 8:
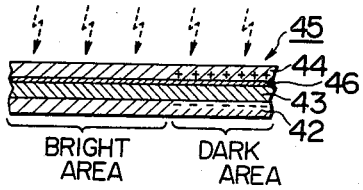

FIGS. 8(I) and (II) schematically illustrate a further example of a sequence of steps for forming an electrostatic latent image on the photosensitive member 45 shown in FIG. 5. As indicated in FIG. 8(I), an image of an original formed by visible light in the first wavelength region is projected onto the photosensitive member 45 while simultaneously projecting a corona ion current of the positive polarity, for example, with a corona charger 50. Such imagewise irradiation which occurs simultaneously with the charging is followed by a uniform exposure by ultraviolet rays as indicated in FIG. 8(II). This causes, in the dark area of the image, charges of opposite polarities to be trapped on opposite sides of the first photoconductive layer 43 in the same manner as in FIG. 7, thus forming the electrostatic latent image.

Figure 9I:
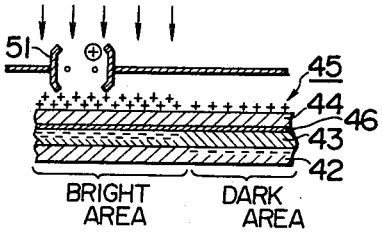
Figure 9:
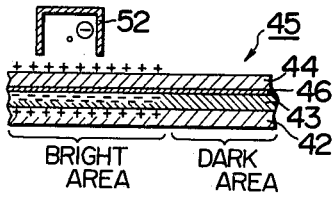

FIGS. 9(I) through (III) schematically illustrate a still further example of a sequence of steps for forming an electrostatic latent image on the same photosensitive member 45 shown in FIG. 5. As indicated in FIG. 9(I), an image of an original formed by visible light in the first wavelength region is projected onto the photosensitive member 45 while simultaneously projecting a corona ion current of the positive polarity, for example, with a corona charger 51 until charge thereon reaches a level close to the saturation thereof. As a consequence, charge in the bright area of the image which is much more than in the dark area in quantity is trapped on opposite sides of the second photoconductive layer 44 and the charge in the dark area of the image is trapped on the surface of the second photoconductive layer 44 and at the interface between the first photoconductive layer 43 and the conductive layer 42, resulting in the formation of substantially equal surface potentials both in the bright and in the dark of the image. Subsequently, as indicated in FIG. 9(II), the surface potential on the photosensitive member 45 is neutralized by a charging of the opposite polarity or by an a.c. charging with a corona charger 52 so that the surface potential thereof reaches zero volts. By this step, the charge in the dark area of the image is eliminated, and in the bright area of the image, the surface charge on the second photoconductive layer 44 decreases, a charge corresponding to the reduction being trapped at the interface between the conductive layer 42 and the first photoconductive layer 43. This results in the formation of substantially equal surface potentials both in the bright and in the dark area of the image. Thereafter, as indicated in FIG. 9(III), a uniform exposure by ultraviolet rays is applied to the photosensitive member 45. The result of such uniform exposure is that in the bright area of the image, the surface charge of the second photosensitive layer 44 and the oppositely polarized charge corresponding thereto which has been trapped at the interface between the first and the second photoconductive layers 43, 44 are eliminated and charge is trapped on opposite sides of the first photoconductive layer 43, thus forming the electrostatic latent image. It is to be understood that when visible light is used in the uniform exposure operation instead of ultraviolet rays, in the bright area of the image, in contrast to the above, the charge which has been trapped at the interface between the conductive layer 42 and the first conductive layer 43 and the oppositely polarized charge corresponding to the trapped charge are eliminated, charge on opposite sides of the second photoconductive layer 44 being left to form the electrostatic latent image.

In the foregoing, there have been described a number of procedures for forming the electrostatic latent image on the photosensitive members shown in FIGS. 3 and 5. It is to be noted, however, that such latent images can be formed by means of any other various procedures.

FIGS. 10(I) through (V) schematically illustrate a sequence of copying steps for describing operations of the electrophotographic copying apparatus of the present invention which employs the photosensitive member illustrated in FIG. 5. FIG. 10(I) illustrates a state that an electrostatic latent image is formed which, with the process as shown in FIG. 6, in the dark area of the image, has charges of opposite polarities on opposite sides of the second photosensitive layer 44. As shown, the polarity of the latent image is different from that in FIG. 6(III) but may be obtained by employing the positive polarity in the step for the uniform charging shown in FIG. 6(I). FIG. 10(II) illustrates a developing step in which the electrostatic latent image is developed with a negatively charged toner 55. FIG. 10(III) illustrates a transfer step in which a toner image formed on the photosensitive member 45 during the developing step is transferred to a copy sheet 58 by an action of a transfer roller 57 which is connected to a transfer bias source 56 and to which a bias voltage is applied. During this step, in which the toner image is transferred to a copy sheet 58, since a transfer roller 57 is in direct contact with photosensitive member 45 in the area beyond image scope, charge is injected into photosensitive member 45 by an electric field applied for the purpose of the transfer operation. Such injection of the charge is much remarkable when a transfer corona charger is employed. If the injected charge is left as it is, a toner is absorbed during the next developing step, causing various difficulties, as described above. FIGS. 10(IV) and (V) illustrate steps for an irradiation of visible light and ultraviolet rays in accordance with the present invention in order to eliminate charge on the area beyond image scope, which are to be performed prior to the next developing step after the toner image has been transferred. FIG. 10(IV) shows a step for an irradiation of visible light in which the visible light is applied by connecting a lamp 59 for radiating the visible light to a power supply 61 through a switch 60. The irradiation region of the visible light is shown by broken lines with an arrow. It is to be understood that when the electrostatic latent image for forming an image is formed by trapping charge on opposite sides of the second photosensitive layer 44, as in this instance, a uniform exposure over the entire surface of the photosensitive member may also be utilized. FIG. 10(V) shows a step for an irradiation of ultraviolet rays on the area beyond image scope in combination with the irradiation of the visible light in FIG. 10(IV), in which the ultraviolet rays are applied by connecting a lamp 62 for radiating the ultraviolet rays to a power supply 64 through a switch 63. This irradiation of ultraviolet rays is limited to a region shown by broken lines with an arrow. However, it is to be understood that when the electrostatic latent image forming an image, as shown in FIGS. 8 and 9, is formed on opposite sides of the first photoconductive layer 43 by trapping charge thereon, a uniform exposure over the entire surface of the photosensitive member may also be utilized. In the steps of FIGS. 10(IV) and (V), the area beyond the image scope is irradiated both by visible light and ultraviolet rays while the area within the image scope is not irradiated by any of visible light and ultraviolet rays or it may be irradiated by light rays in the wavelength region to which is sensitive a photoconductor not holding the electrostatic latent image over the entire surface of the photosensitive member. In addition, it is to be noted that the steps for irradiating visible light and ultraviolet rays may be changed in order or may occur at the same time. Thus, with the irradiation of visible light and ultraviolet rays on the area beyond the image scope, the charge injected into the area during the transfer step is trapped on opposite sides of the second photosensitive layer 44 by the irradiation of visible light shown in FIG. 10(IV) and is eliminated by the irradiation of ultraviolet rays shown in FIG. 10(V). Subsequently, steps shown in FIGS. 10(II) through (V) are repeated, whereby a plurality of copies can be produced with the electrostatic latent image which is once formed on photosensitive member 45.

Figure 11:
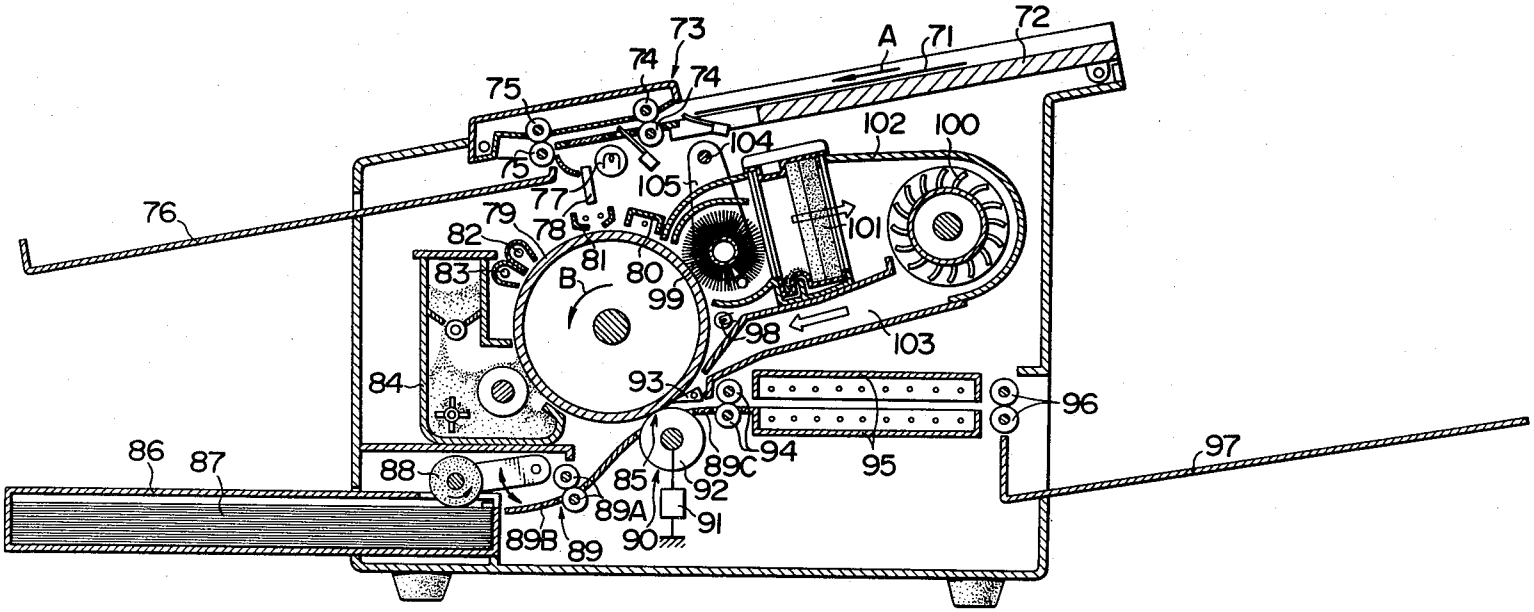
FIG. 11 is a schematic section view of the electrophotographic copying apparatus according to an embodiment of the present invention.

FIG. 11 is a schematic sectional view of the electrophotographic copying apparatus illustrating an embodiment of the present invention, which operates in accordance with processes indicated in FIGS. 6 and 10. A sheet-shaped original 71 is placed on an inclined table 72 to be led into an original conveyor 73 in the direction indicated by an arrow A and then is ejected into a tray 76 by conveyor rollers 74, 75 which constitute an original feeding conveyor 73. Original 71, during its conveyance, is irradiated by a lamp 77 and its image is projected onto a rotating drum 79 which is sensitive to irradiation rays through an optical system 78 (a fiber lens array). The drum 79 is formed as shown in FIG. 3 or FIG. 5. The drum 79 which rotates in the direction indicated by an arrow B is initially charged in a uniform manner by a corona charger 80 and subsequently is neutralized with a corona charger 81 during the above-mentioned irradiation of the image. Thereafter, the drum 79 is subjected to a uniform exposure by a lamp 82 for visible light to form an electrostatic latent image corresponding to the optical image. In this instance, a lamp 83 for producing ultraviolet rays is provided close to visible light lamp 82 so as to irradiate ultraviolet rays on an area beyond the image scope by lamp 83 during the formation of the electrostatic latent image. The irradiation of ultraviolet rays by ultraviolet lamp 83 may be carried out by turning it on and off with a switch to irradiate only on the area beyond the image scope or by controlling the opening and closing of a shutter (not shown for purposes of simplicity) which is provided in front of lamp 83. Thus, when the irradiations of visible light and ultraviolet rays are carried out at least on the area beyond the image scope prior to a first developing operation, the charge which has been trapped on the area beyond the image scope can be eliminated and therefore toner will not be deposited on the area beyond the image scope even during the first developing operation, ensuring an effective prevention against a waste of toner and a contamination on the back of copy sheets.

As described above, the electrostatic latent image formed on drum 79 is developed with toner by a dry type two component developer 84 and then the toner image thus formed is transferred to a toner image transfer station 85 as drum 79 is rotated. On the other hand, a copy sheet 87 arranged in a cassette 86 for copy sheets is picked up, one by one, by means of an oscillating and rotating pick-up roller 88 and is conveyed to toner image transfer station 85 at a predetermined timing through a conveyor path 89 which is provided with a conveyor roller 89A and a guide 89B. The copy sheet at the transfer station 85 is conveyed in contact with drum 79 so as to overlap with the toner image and thereupon the toner image is transferred thereto by action of a transfer unit 90. The transfer unit 90 may be constructed by employing a d.c. corona charger. In this instance, the unit 90 is arranged in contact with drum 79 so as to effectively maintain the electrostatic latent image on drum 79 for producing a plurality of copies and utilizes a bias roller type transfer unit which is provided with a semiconductive transfer roller 92 connected to a transfer bias source 91. Since the copy sheet which has passed the toner image transfer station 85 is conveyed in contact with drum 79, the copy sheet is separated from drum 79 by a claw 93 and an airstream to be described later and then is conveyed along a guide 89C, which forms a copy sheet conveyor path 89 into a part of the fixing unit 95 including a heater, by means of a conveyor roller 94. Thereupon, the toner image is fixed and then the copy sheet is ejected into copy tray 97 by a ejecting rollers 96.

A neutralizing lamp 98 for irradiating ultraviolet rays is arranged downstream of the transfer station 85, as viewed from the rotational direction of drum 79. After the electrostatic latent image is eliminated by a uniform irradiation of ultraviolet rays on drum 79 with lamp 98, any remaining toner is removed by a cleaning brush 99. The removed toner is absorbed by airstream caused by an rotation of a fan 100 and is collected in a filter 101. The cleaning brush 99 and the fan 100 are covered with a housing 102 so as to obtain an effective absorbing force of the toner and also so as not to scatter the toner throughout the apparatus. The exhaust of fan 100 is led to a duct 103 so that it may be discharged from an outlet facing the transfer station 85 and is utilized to effectively separate the copy sheet from drum 79 in cooperation with claw 93. Cleaning brush 99 is rotatably mounted on arm 105 which is movably mounted on a support stem 104.

In the course of producing a plurality of copies by repeatedly subjecting an electrostatic latent image which is once formed on drum 79 only to a developing step with toner and a transfer step, neutralizing lamp 98 is turned off and cleaning brush 99 is kept in separated relationship with drum 79. Visible light lamp 82 and ultraviolet ray lamp 83 are controlled so as to be turned on only to irradiate the area beyond the image scope. The irradiations by these lamps 82 and 83 are equivalent to the processes in FIGS. 10(IV) and (V). When the electrostatic latent image is retained on the first photoconductive layer (see FIGS. 7 through 9), ultraviolet lamp 83 may be continuously turned on and when the latent image is retained on the second photoconductive layer as in this instance, visible light lamp 82 may be continuously turned on. Additionally, when the area beyond the image scope spreads in the direction of width of drum 79, for example, indicated by a letter X in FIG. 12, the X-directional area beyond the image scope and the area beyond the image scope in the circumferential direction Y of drum 79 are irradiated by turning on and off irradiation lamps at timings different from each other. By way of examples, this turning on and off control may be performed, in such a manner that a first lamp which irradiates only on the area in the direction of width X of drum 79 and a second lamp which irradiates over the entire width of drum 79 are provided separately so that the first lamp is always turned on and the second lamp is turned on and off in synchronized relationship with rotation of drum 79 to neutralize a charge on the area in the direction Y, or that a shutter which is divided into segment-shaped forms in the direction of width of drum 79 is provided for opening and closing each divided shutter independently under condition that a lamp is always turned on.

In FIG. 11, visible light lamp 82 and ultraviolet ray lamp 83 are provided separately. However, it is to be noted that a lamp which radiates simultaneously both ultraviolet rays and visible light may be employed so as to have the combined functions of lamps 82 and 83. In addition, signals for indicating turning on and off of the lamps or opening and closing control of the shutter may be generated, for example, when a micro-switch is turned on and off by a cam disc which rotates integrally with drum 79, or by whether or not the number of pulses from a pulse generator which generates pulses in cooperation with drum 79 reach a predetermined value. Noting FIG. 11*a*, for example, the portions 106*a* and 108*a* of cam discs 106 and 108, respectively engage arms 107*a* and 109*a* of microswitches 107, 109. When larger size copies are being produced, switch 110 is closed. The smaller cam portion 106*a* maintains the neutralizing lamp 82 (and/or 83) energized for a period sufficient to neutralize the smaller area beyond the image scope as the shaft 79*a* of drum 79 rotates. Closing switch 111 when producing smaller size copies energizes lamp 82 (and/or 83) to neutralize the larger area beyond the image scope. Furthermore, when the electrostatic latent image is formed on the first photoconductive layer by the process including a uniform exposure of ultraviolet rays, as indicated in any of FIGS. 7 through 9, the latent image may be eliminated in such a manner that an irradiation of visible light is applied prior to the first developing operation and irradiations of visible light and ultraviolet rays are applied on the area beyond the image scope during the process for producing a plurality of copies while a uniform exposure of visible light is applied by a neutralizing lamp thereof after the desired number of copies have been produced.

As will be apparent from the foregoing, a neutralizing unit which irradiates visible light and ultraviolet rays on the area beyond the image scope, when the neutralization is performed during a formation of the electrostatic latent image, is arranged downstream of a corona charger for forming the latent image and upstream of a developing unit, as viewed from the rotational direction of the photosensitive member, while when charge which has been injected from the transfer unit during the process for forming a plurality of copy images with the same latent image is to be neutralized, the neutralizing unit is arranged downstream of the transfer unit and upstream of the developing unit. When the neutralizations while forming a latent image and while producing a plurality of copies are performed with the same unit, the unit is arranged downstream of the corona charger for forming the latent image and upstream of the developing unit. Further, an incandescent lamp, a fluorescent lamp, a cold cathode discharge tube or the like may be used as the visible light lamp. As the ultraviolet ray lamp, lamps well known as a sterilization lamp or a black light may be used which include a discharge lamp of the same construction as a fluorescent lamp which has a tube made of material of ultraviolet ray transmitting glass and which is not applied with fluorescent material or applied with ultraviolet and fluorescent material, or a black light which is not applied with fluorescent material in a cold cathode discharge lamp or applied with ultraviolet and fluorescent material and has a tube material replaced by a ultraviolet ray transmitting material, or the like. In addition, as a power supply for simultaneously radiating both ultraviolet rays and visible light may be used a discharge lamp which is applied with a fluorescent material except an opening in a slit-shaped form or thinly applied with a fluorescent material or applied with a fluorescent material in a form of meshes of a net.

What is claimed is:

1. An electrophotographic copying apparatus including a photosensitive member which includes a conductive layer carrying a sequential lamination of a first photoconductive layer which is sensitive to visible light and a second photosensitive layer which is sensitive to ultraviolet radiation and serves as an insulator to the visible light, said photosensitive member on which is formed an electrostatic latent image being repeatedly conveyed to a developing station and a transfer station in sequential fashion to produce a plurality of copies with said electrostatic latent image which has been formed thereon, the apparatus characterized by provision of neutralizing means for an irradiation of the conductive layer with visible light and ultraviolet rays to neutralize charge on an area beyond image scope of the photosensitive member, said neutralizing means being disposed upstream of the developing station and downstream of the transfer station, as viewed with regard to a direction of the conveyance of the photosensitive member.

2. An electrophotographic copying apparatus according to claim 1 in which the neutralizing means is operated during the copying process to produce a plurality of copies with the electrostatic latent image which has been formed on the photosensitive member.

3. An electrophotographic copying apparatus according to claim 1 including a corona charger for charging said photosensitive member, said neutralizing means being disposed upstream of the developing station and downstream of said corona charger for charging the photosensitive member in order to form the electrostatic latent image in such a manner that at least one of visible light and ultraviolet rays is irradiated on the area beyond image scope of the photosensitive member prior to a first developing step by said developing station.

4. An electrophotographic copying apparatus according to claim 2 in which the neutralizing means comprises a lamp for irradiating visible light and another lamp for irradiating ultraviolet rays in such a manner that the visible light or the ultraviolet ray from one of these lamps are applied to the entire surface of the photosensitive member during the formation of the electrostatic latent image and the visible light or the ultraviolet ray from the other lamp is applied only to the area beyond image scope prior to the first developing step.

5. The copying apparatus of claim 1 further comprising energizing means responsive to movement of the photosensitive member for energizing said neutralizing means to irradiate the area beyond image scope.

6. The copying apparatus of claim 5 wherein said photosensitive member is a rotatable cylindrical drum, said energizing means being responsive to rotation of said drum.

7. The copying apparatus of claim 6, comprising switch means for energizing said neutralizing means and means responsive to rotation of said drum for operating said switch means.

* * * * *

UNITED STATES PATENT AND TRADEMARK OFFICE

CERTIFICATE OF CORRECTION

PATENT NO. : 4,392,737

DATED : July 12, 1983

INVENTOR(S) : Nishikawa

It is certified that error appears in the above—identified patent and that said Letters Patent is hereby corrected as shown below:

Column 1, line 29, change "surace" to --surface--.

Line 22, change "1" to --1--;

Line 33, change "1" to --1--.

Column 3:

Line 1, change "21" to --21--;

Line 17, change "21" to --21--;

Line 31, change "21" to --21--.

Column 4:

Line 43, change "41" to --41--;

Line 52, change "41" to --41--.

UNITED STATES PATENT AND TRADEMARK OFFICE

CERTIFICATE OF CORRECTION

PATENT NO. : 4,392,737

DATED : July 12, 1983

INVENTOR(S) : Nishikawa

It is certified that error appears in the above—identified patent and that said Letters Patent is hereby corrected as shown below:

Column 5, line 32, change "45" to --45--.

Column 6:

Line 11, change "41" to --41--;

Line 13, change "41" to --41--;

Line 26, change "41" to --41--;

Line 30, change "41" to --41--;

Line 40, change "45" to --45--;

Line 44, change "45" to --45--;

Line 46, change "45" to --45--;

Line 50, change "45" to --45--;

Line 62, change "45" to --45--;

Line 66, change "45" to --45--.

UNITED STATES PATENT AND TRADEMARK OFFICE

CERTIFICATE OF CORRECTION

PATENT NO. : 4,392,737

DATED : July 12, 1983

INVENTOR(S) : Nishikawa

It is certified that error appears in the above—identified patent and that said Letters Patent is hereby corrected as shown below:

Column 7:

Line 11, change "45" to --45--;

Line 14, change "45" to --45--;

Line 28, change "45" to --45--;

Line 41, change "45" to --45--.

Column 8:

Line 12, change "45" to --45--;

Line 18, change "45" to --45--;

Line 19, change "45" to --45--.

Column 9:

Line 6, change "45" to --45--.

UNITED STATES PATENT AND TRADEMARK OFFICE

CERTIFICATE OF CORRECTION

PATENT NO. : 4,392,737

DATED : July 12, 1983

INVENTOR(S) : Nishikawa

It is certified that error appears in the above-identified patent and that said Letters Patent is hereby corrected as shown below:

Column 10, line 16, after "by" (first occurrence) insert -- an --.

Signed and Sealed this

*Fourteenth* Day of *February 1984*

[SEAL]

*Attest:*

GERALD J. MOSSINGHOFF

*Attesting Officer*

*Commissioner of Patents and Trademarks*